United States Patent [19]

Guest et al.

[11] Patent Number: 4,858,536

[45] Date of Patent: Aug. 22, 1989

[54] ASH PAN ASSEMBLY FOR WOOD BURNING STOVE

[75] Inventors: John H. Guest, Norwich; Lewis E. Crain, Randolph, both of Vt.

[73] Assignee: Vermont Castings, Inc., Randolph, Vt.

[21] Appl. No.: 849,683

[22] Filed: Apr. 9, 1986

[51] Int. Cl.[4] ..... F23J 1/00

[52] U.S. Cl. ..... 110/166; 126/243; 126/245

[58] Field of Search ..... 110/165 R, 166, 259; 126/243, 245, 242, 58, 67, 80

[56] References Cited

U.S. PATENT DOCUMENTS

| | | | |
|---|---|---|---|
| 162,267 | 4/1875 | Bleyley . | |
| 332,527 | 12/1885 | Hofer et al. . | |
| 420,559 | 2/1890 | Lincoln . | |
| 500,569 | 7/1893 | Fuller . | |
| 818,628 | 4/1906 | Janes | 126/242 |
| 1,278,736 | 9/1918 | Peterson . | |
| 1,301,322 | 4/1919 | Ruud | 110/259 |
| 1,629,336 | 5/1927 | Clements . | |
| 1,887,041 | 11/1932 | Remy . | |
| 2,116,017 | 5/1938 | Franke | 126/245 |
| 2,408,921 | 10/1946 | Esson | 126/245 |
| 2,800,892 | 7/1957 | Gontero | 126/243 |
| 2,845,882 | 8/1958 | Bratton . | |
| 4,319,556 | 3/1982 | Schwartz et al. | 126/77 |
| 4,347,831 | 9/1982 | Graziano | 126/83 |
| 4,363,785 | 12/1982 | Wilson | 422/173 |
| 4,465,055 | 8/1984 | Bortz | 126/123 |
| 4,466,358 | 8/1984 | Christian | 110/211 |

FOREIGN PATENT DOCUMENTS

| | | | |
|---|---|---|---|
| 1003934 | 2/1955 | Fed. Rep. of Germany . | |
| 947567 | 8/1956 | Fed. Rep. of Germany . | |
| 334088 | 8/1930 | United Kingdom . | |
| 735742 | 8/1955 | United Kingdom | 126/ |
| 772187 | 4/1957 | United Kingdom | 126/243 |
| 817882 | 8/1959 | United Kingdom . | |
| 992340 | 5/1965 | United Kingdom . | |
| 1472591 | 5/1977 | United Kingdom . | |
| 2052045 | 1/1981 | United Kingdom . | |

OTHER PUBLICATIONS

"Rayburn Coalglo"Brochure, 06-1981, pp. 1-10.
"Parkray Everglow"Brochure, pp. 1-2.
"Blue Ridge Mountain Stoveworks"Brochure, 10-1983, pp. 1-4.
"Model 20 Fireplace Insert"Brochure, pp. 1-2.

*Primary Examiner*—Steven E. Warner
*Attorney, Agent, or Firm*—Wolf, Greenfield & Sacks

[57] ABSTRACT

An ash pan assembly for a wood burning or coal burning stove includes an ash pan door permanently attached to the stove and mounted for movement between a closed ash collection position and an open position. An ash pan is mounted to the movable ash pan door. A detachable ash pan cover is easily attached to the ash pan in the open position. The ash pan cover prevents accidental spillage of ashes and hot coals from the ash pan and includes a carrying handle by which the ash pan is lifted from the assembly and taken for disposal. The ash pan door is preferably hinged to the front wall of the stove for swinging to the open position.

8 Claims, 4 Drawing Sheets

ASH PAN ASSEMBLY FOR WOOD BURNING STOVE

FIELD OF THE INVENTION

This invention relates to a wood burning stove and more particularly, to a wood burning stove provided with a novel ash pan assembly which permits disposal of ashes without the mess and inconvenience normally associated with ash disposal.

BACKGROUND OF THE INVENTION

In recent years, wood and coal burning stoves have gained widespread popularity as a means of home heating. These stoves operate efficiently and for long periods in a slow combustion mode. The joints of the stove are tightly sealed, and air flow to the stove is carefully controlled. Such stoves are usually used in a living area of a home such as a living room, family room, den or kitchen.

All stoves require removal of ash buildup from time to time. In some stoves, the ashes build up at the base of the combustion chamber and are simply shoveled out. Other stoves employ a grate positioned at the base of the combustion chamber for support of the wood or other fuel. Ashes drop through holes in the grate into an ash pan located in a compartment in the base of the stove. The ash pan is usually an open-topped box and is accessed through a door in the front or side of the stove base. See for example, U.S. Pat. Nos. 4,466,358 and 4,363,785 and U.K. Patent Application No. 2052045. The door and ash pan have been combined to form an ash drawer. See for example, U.S. Pat. Nos. 4,347,831 and 2,845,882.

The ash buildup in wood stoves contains material which is extremely light and can be spilled or blown about by the slightest disturbance or breeze. In addition, the ash buildup often includes still-burning charcoal fragments when the stove was recently used or is still in use. The spillage of such ash and hot charcoal is highly undesirable in a home where rugs and furniture are near the stove. An inconvenient cleanup will be required, and if hot charcoal is spilled, the furniture or rug is likely to be permanently damaged. Furthermore, if spillage of hot charcoal is not noticed, a fire can occur.

It is a general object of the present invention to provide a novel ash pan assembly for use with wood burning and coal burning stoves.

It is another object of the present invention to provide a novel ash pan assembly which permits safe and clean disposal of ashes from a wood burning or coal burning stove.

It is a further object of the present invention to provide a novel ash pan assembly wherein the ash pan containing ashes and coal can be covered before it is detached from the stove.

It is a further object of the present invention to provide a heating apparatus with a permanently attached ash pan door and an ash pan mounted for easy removal from the ash pan door.

SUMMARY OF THE INVENTION

According to the present invention, these and other objects and advantages are achieved in a heating apparatus for burning solid fuel comprising a frame assembly defining a combustion chamber and an ash pan assembly positioned below the combustion chamber for receiving ashes therefrom. The ash pan assembly includes an ash pan door movably attached to the stove, an ash pan generally in the form of an open-topped box and including means for attachment to an ash pan cover, and means for mounting the ash pan to the ash pan door so as to be easily removable therefrom.

The ash pan door is preferably hinged to a front wall of the stove, and the ash pan is mounted at the rear of the ash pan door so as to swing out with the ash pan door when it is opened. The means for attachment to the ash pan cover preferably includes overhanging ribs on the ash pan for slidably receiving the ash pan cover. The ash pan is removed from its mounting position at the rear of the ash pan door by lifting the ash pan cover.

BRIEF DESCRIPTION OF THE DRAWINGS

For a better understanding of the present invention together with other and further objects, advantages and capabilities thereof, reference may be had to the accompanying drawings which are incorporated herein by reference and in which.

DETAILED DESCRIPTION OF THE INVENTION

Figure 1:
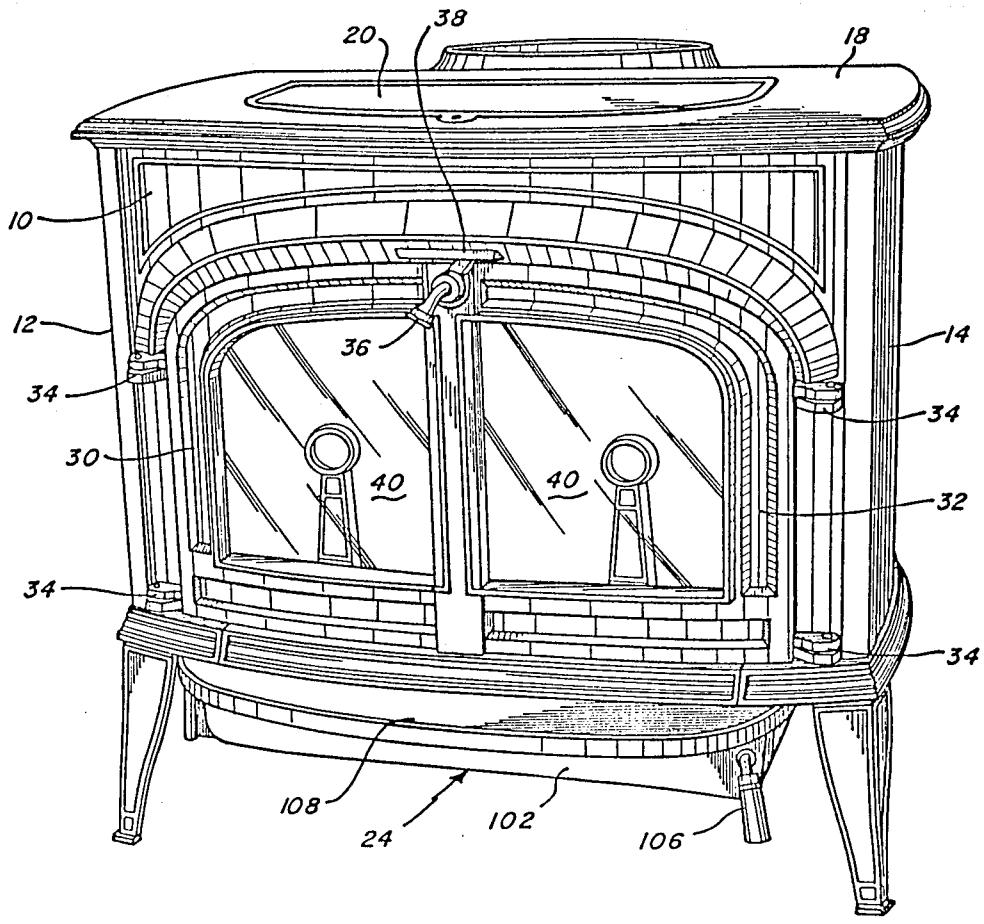
FIG. 1 is a perspective view of a wood burning stove in accordance with the present invention.

A wood stove in accordance with the present invention is shown in FIG. 1. The stove includes a generally vertical front wall 10, side walls 12 and 14 and a rear wall 16 (see FIG. 2). A top 18 of the frame assembly includes a removable griddle 20. A bottom 22 of the frame assembly supports an ash pan assembly 24 for receiving and storing ashes. The above-identified elements of the frame assembly define a combustion chamber 28 where wood is burned.

The stove is provided with doors 30, 32 connected by hinges 34 to the front wall 10. The doors 30, 32 pivot outwardly from the stove about respective vertical axes through the hinges 34. In the closed position, the door 32 overlaps the door 30. A latching handle 36 engages a lip 38 on the front wall 10 to securely seal the doors 30, 32 in a closed position. Each of the doors 30, 32 is provided with a transparent glass panel 40 for viewing of the fire in the combustion chamber, while maintaining the frame assembly airtight. The glass panels 40 take up a relatively large portion of each door 30, 32 and are positioned relative to the combustion chamber 28 to permit an aesthetically pleasing view of the fire therein. The glass viewing panel can be mounted in one of the walls of the stove if desired.

The stove is provided with a glass panel cleaning system for maintaining the glass panels 40 in a clean and transparent condition so as to permit viewing of the fire in the combustion chamber throughout the life of the stove. The glass cleaning system includes a system of internal manifolds for directing a curtain of hot air flowing uniformly and downwardly without turbulence over the interior surface of the glass panels 40. The system uses clean, hot air which blocks contaminants from reaching the glass and maintains the glass at an elevated temperature to prevent soot and creosote deposits. The glass panel cleaning system overcomes the difficulty of prior art systems in maintaining clean glass in low heat output, slow combustion conditions. Thus, the stove can be operated over a wide range of heat outputs, typically 15,000 to 50,000 BTU per hour while maintaining clean glass.

Figure 2:
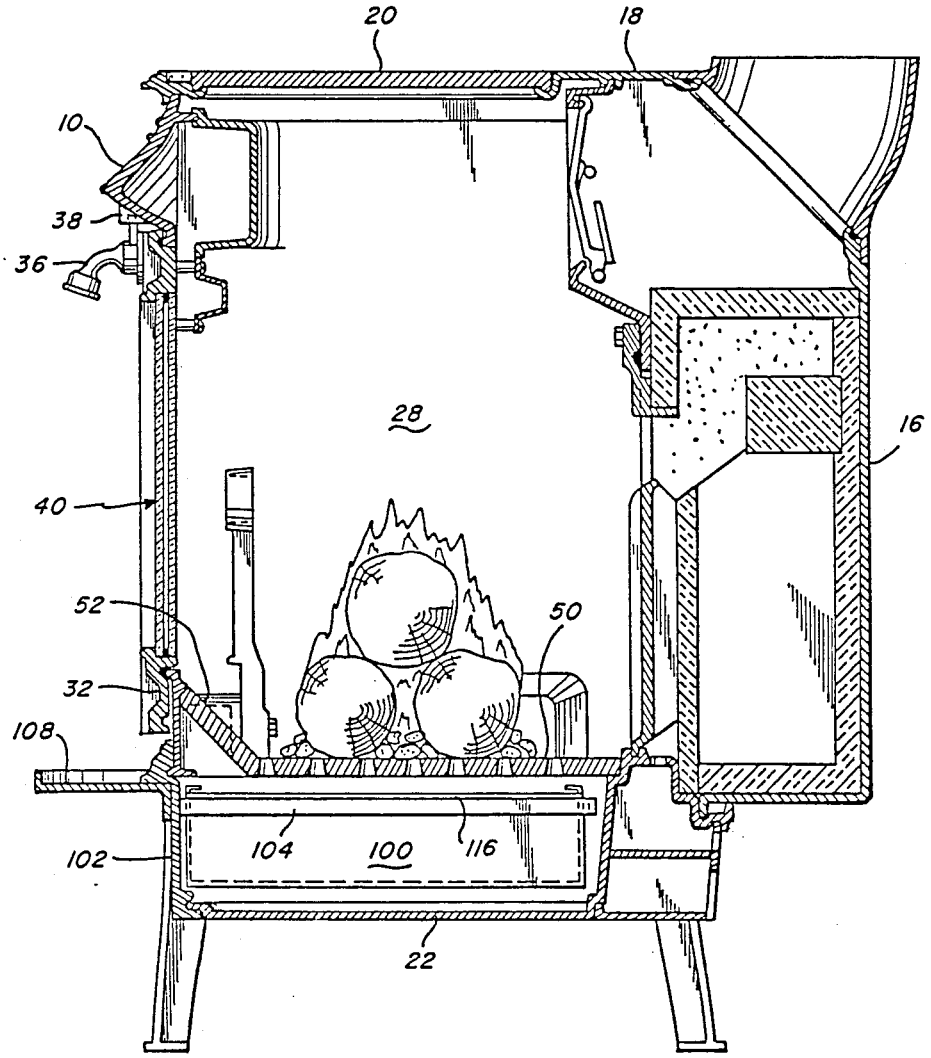
FIG. 2 is a cross-sectional side view of the wood burning stove shown in FIG. 1.

A wood grate 50 is mounted above the ash pan assembly 24, as shown in FIG. 2. The wood grate 50 contains holes, slots or other perforations to permit ashes to drop into the ash pan assembly 24. Wood or other solid fuel is supported by the grate 50 for burning. The stove is provided with an air deflection element 52 mounted near the base of the doors 30, 32 and extending rearwardly at an angle to the doors 30, 32 toward the wood grate 50. The element 52 deflects, or redirects. the curtain of hot air, which flows downwardly across the glass panels 40, toward the base of the fire on the wood grate 50.

An ash pan assembly in accordance with the present invention includes, generally, an ash pan door permanently attached to the stove and mounted for movement between a closed position and an open position. An ash pan is mounted to the ash pan door and moves with the door between the open position and the closed position. In the closed position, the ash pan is located beneath the wood grate for ash collection. In the open position, the ash pan is accessible for removal by lifting from the assembly for ash disposal. A detachable ash pan cover is easily attached to the ash pan for carrying of the ash pan and ash disposal. The ash pan cover prevents accidental spillage of ashes and hot coals from the ash pan and includes a carrying handle by which the ash pan is lifted from the assembly and taken for disposal.

Figure 3:
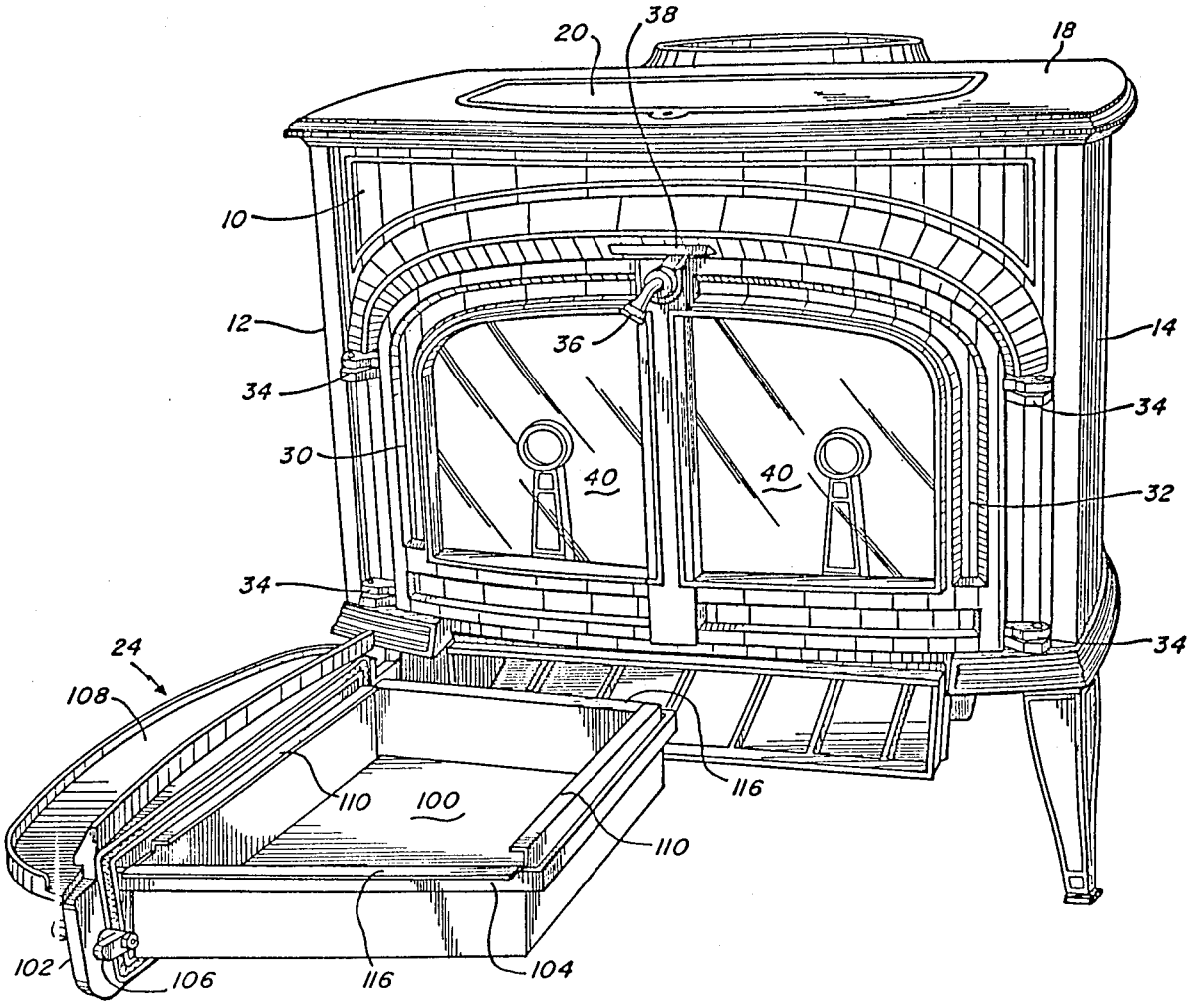
FIG. 3 is a perspective view of the wood burning stove of FIG. 1 with the ash pan assembly swung out.
Figure 4:
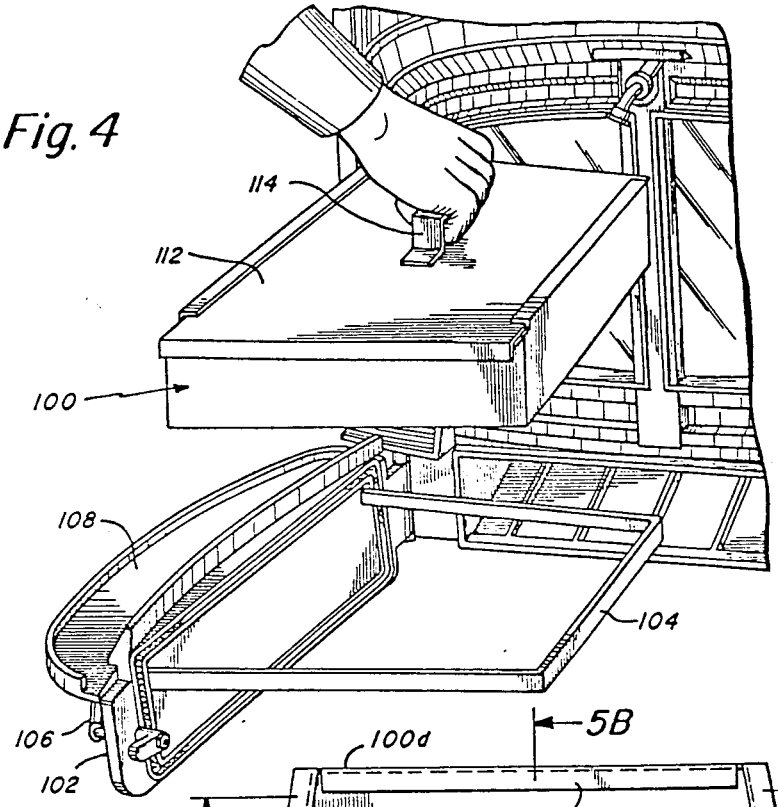
FIG. 4 shows the ash pan assembly with the ash pan cover inserted and the ash pan lifted out.
Figure 5A:
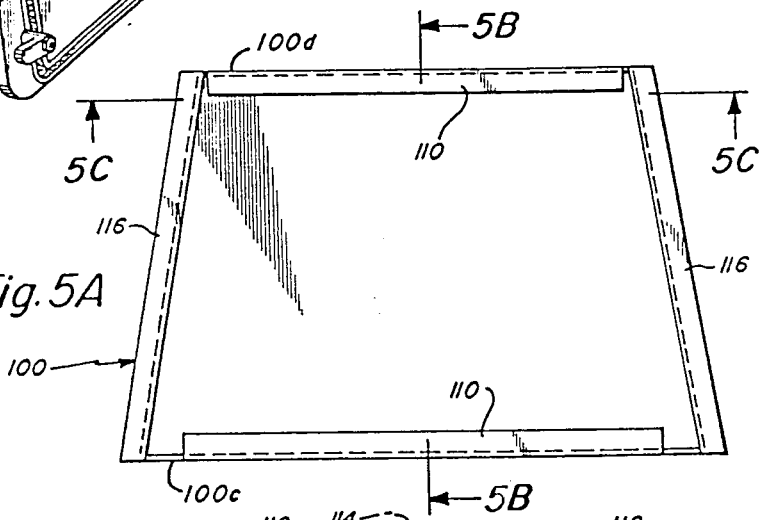
FIGS. 5A-5C illustrate the details of the ash pan construction.
Figure 5B:
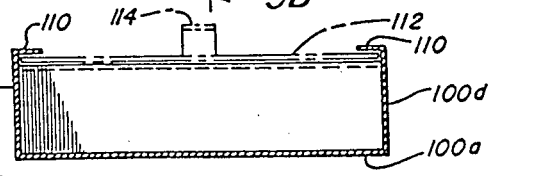
Figure 5C:
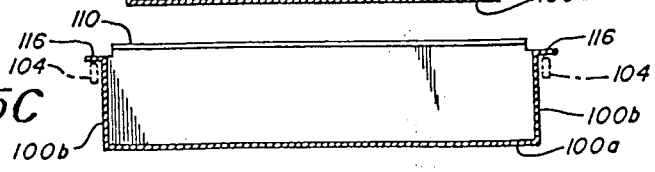

The details of a preferred embodiment of the ash pan assembly 24 are shown in FIGS. 3–5. An ash pan 100 is supported at the rear of a hinged ash removal door 102 by a mounting bracket 104. The door 102 is hinged at the left edge for pivoting around a vertical axis and includes a latch 106 for latching the door 102 in a closed position. The door 102 may be provided with an outwardly extending tray 108 to catch ashes and coals which accidentally fall out of the stove when the doors 30, 32 are opened. The ash pan 100 is in the form of a low profile, open-topped metal box with a generally flat bottom **100*a*, sidewalls 100*b*, a front wall 100*c* and a rear wall 100*d*, as shown in FIGS. 5A–5C. In one embodiment the ash pan 100 has a trapezoidal shape, as viewed from above, to correspond with the shape of the combustion chamber and to facilitate swinging of the hinged door 102 and the ash pan 100 to the open position. It will be understood that the ash pan 100** can have any convenient shape, depending on the details of the stove construction.

The ash pan is provided at the tops of the front wall 100c and rear wall **100*d* with inwardly extending, overhanging ribs 110 which are used to retain an ash pan cover 112. The ash pan cover 112 is a metal sheet provided with a handle 114. The cover 112 is preferably flat or domed with the handle 114 centrally located for balanced carrying. The cover 112 slides over the ash pan 100 but under the overhanging ribs 110 and is dimensioned to cover the top of the ash pan 100. The ash pan 100 is then lifted out of the mounting bracket 104 by handle 114 for disposal of the ashes. The disclosed ash pan assembly 24 permits removal of ashes in a clean and safe manner since the cover 112 is put in place before the ash pan 100 is removed from the stove. Therefore, the chance for spillage of ashes and hot coals is substantially eliminated. The ash pan 100 can be removed from the front of the stove without opening the main doors 30, 32** and without a need for a shovel.

The tops of sidewalls **100*b* are provided with outwardly extending overhanging ribs 116, as shown in FIG. 5C, which rest on mounting bracket 104. The mounting bracket 104 can be a metal strip appropriately shaped to extend from ash pan door 100 rearwardly along sidewalls 100b and along rear wall 100*d* of ash pan 100. It will be understood that the mounting bracket 104 can have any convenient construction for support of the ash pan 100. For example, the ash pan 100 can be supported at its bottom 100*a*. Also, the locations of the ribs 110 and the ribs 116 can be reversed such that the cover is inserted perpendicular to the door 102 and the ash pan 100 is supported at its front and rear. Also, it is understood that the means of attaching the cover 112 is not restricted to ribs or flanges, but may include latches, snaps or other means of easily attaching the cover to the ash pan 100**. It will also be understood that the door may be attached to the stove by means other than a hinge, such as glides or slides or other means, which permit it to be pulled from the closed position to the open position but still attached to the stove.

While there has been shown and described what is at present considered the preferred embodiments of the invention, it will be obvious to those skilled in the art that various changes and modifications may be made therein without departing from the scope of the present invention as defined by the appended claims.

What is claimed is:

1. A heating apparatus for burning solid fuels comprising:

a frame assembly defining a combustion chamber; and an ash pan assembly positioned below said combustion chamber for receiving ashes therefrom, said ash pan assembly including an ash pan door hinged to a front wall of said frame assembly for pivoting about a vertical axis to and between an ash collection position and an open position, an ash pan generally in the form of an open-topped box including means for attachment to an ash pan cover, means for mounting said ash pan to said ash pan door so as to be easily removable therefrom, said mounting means comprising support bracket means extending rearwardly from said door or opposite sides of said ash pan, said ash pan including outwardly overhanging ribs for resting on said support bracket means, and an ash pan cover engagable with said ash pan and having a handle for lifting said ash pan from said ash pan door when said ash pan door is in said open position.

2. A heating apparatus as defined in claim 1 wherein said cover attachment means includes overhanging ribs for slidably receiving the ash pan cover.

3. A heating apparatus as defined in claim 1 wherein said ash pan is narrower at the rear of the appartus to facilitate swinging outwardly with said hinged door.

4. A heating apparatus as defined in claim 1 wherein the said means for attachment to an ash pan cover includes means for slidably receiving said ash pan cover to permit said ash pan to be lifted out by said cover.

5. A heating apparatus as defined in claim 1 wherein said frame assembly includes a main door for access to said combustion chamber and wherein said ash pan door is located below said main door.

6. A heating apparatus as defined in claim 5 further including a grate at the base of said combustion chamber for support of the solid fuel therein, said grate having openings to permit ashes to drop into said pan.

7. A heating apparatus for burning solid fuels comprising:

a frame assembly defining a combustion chamber having an air inlet and a gas exit; and an ash pan assembly for collecting ashes from said combustion chamber and for facilitating ash removal, said ash pan assembly including an ash pan door hinged to said frame assembly for pivoting movement about a vertical axis, an ash pan generally in the form of an open-topped box, said ash pan door including means for supporting said ash pan such that said ash pan rests on said support means and is carried by the ash pan door during pivoting movement about said vertical axis to and between a closed ash collection position below said combustion chamber and an open ash removal position in which said ash pan is entirely outside said frame assembly and can be lifted from said ash pan door, said ash pan including outwardly extending ribs for resting on said support means, and an ash pan cover engagable with said ash pan in said ash removal position for covering said ash pan, said ash pan cover having a handle for lifting said ash pan from said support means.

8. A heating apparatus as defined in claim 7 wherein said frame assembly includes a grate at the bottom of said combustion chamber, said grate having a plurality of openings and wherein said ash pan is located in said ash collection position below said grate, whereby ashes drop from said combustion chamber into said ash pan.

* * * * *